US011154971B2

(12) United States Patent
Hung

(10) Patent No.: US 11,154,971 B2
(45) Date of Patent: Oct. 26, 2021

(54) NAIL GUN

(71) Applicant: Basso Industry Corp., Taichung (TW)

(72) Inventor: Liang-Chi Hung, Taichung (TW)

(73) Assignee: Basso Industry Corp., Taichung (TW)

( * ) Notice: Subject to any disclaimer, the term of this patent is extended or adjusted under 35 U.S.C. 154(b) by 250 days.

(21) Appl. No.: 16/358,947

(22) Filed: Mar. 20, 2019

(65) Prior Publication Data

US 2019/0299381 A1 Oct. 3, 2019

(30) Foreign Application Priority Data

Mar. 29, 2018 (TW) ..... 107110876

(51) Int. Cl.
*B25C 1/00* (2006.01)
*B25C 1/04* (2006.01)
*B25C 1/18* (2006.01)

(52) U.S. Cl.
CPC ..... *B25C 1/008* (2013.01); *B25C 1/005* (2013.01); *B25C 1/04* (2013.01); *B25C 1/043* (2013.01); *B25C 1/047* (2013.01); *B25C 1/184* (2013.01); *B25C 1/188* (2013.01)

(58) Field of Classification Search
CPC ..... B25C 1/008; B25C 1/04; B25C 1/047; B25C 1/184; B25C 1/006; B25C 1/001
USPC ..... 227/114, 118, 120
See application file for complete search history.

(56) References Cited

U.S. PATENT DOCUMENTS 3,563,438 A * 2/1971 Doyle ..... B25C 5/1627 227/8
3,572,572 A * 3/1971 Readyhough ..... B25C 1/008 227/8
3,905,535 A * 9/1975 Novak ..... B25C 1/008 227/120
7,677,426 B2 * 3/2010 Tillinghast ..... B25C 1/043 227/130
8,561,869 B2 * 10/2013 Towfighi ..... B25C 1/06 227/130
8,684,246 B2 * 4/2014 Liang ..... B25C 1/04 227/130
8,800,835 B2 * 8/2014 Perron ..... B25C 1/008 227/8

(Continued)

FOREIGN PATENT DOCUMENTS

DE 2247072 A1 4/1974
EP 2441552 A2 4/2012

(Continued)

OTHER PUBLICATIONS

The Search Report issued to European counterpart application No. 19165297.3 by the EPO dated Sep. 4, 2019.

*Primary Examiner* — Gloria R Weeks
(74) *Attorney, Agent, or Firm* — Burris Law, PLLC

(57) ABSTRACT

A nail gun includes a power module, a magazine module and a detection module. The power module performs a nail-driving operation by receiving a first pressure, and is prevented from receiving the first pressure when the power module is subjected to a second pressure. The detection module includes a valve rod and a detection member operable to pivot between an unsealing position and a sealing position. The detection member is moved to the sealing position when the number of the nails in the magazine module is less than a predetermined amount.

11 Claims, 5 Drawing Sheets

(56) References Cited

U.S. PATENT DOCUMENTS

| | | | | |
|---|---|---|---|---|
| 8,925,780 | B2 * | 1/2015 | Largo | B25C 1/005 227/2 |
| 10,723,037 | B2 * | 7/2020 | Hung | B25C 1/043 |
| 10,800,021 | B2 * | 10/2020 | Tanaka | B25C 1/047 |
| 10,814,466 | B2 * | 10/2020 | Hung | B25C 1/008 |
| 2009/0039132 | A1 * | 2/2009 | Kubo | B25C 1/008 227/8 |
| 2009/0039134 | A1 * | 2/2009 | Kubo | B25C 1/008 227/120 |
| 2009/0302087 | A1 * | 12/2009 | Liang | B25C 1/008 227/130 |

FOREIGN PATENT DOCUMENTS

| | | | |
|---|---|---|---|
| GA | 879401 | A | 8/1971 |
| TW | I349600 | A | 10/2011 |

* cited by examiner

NAIL GUN

CROSS-REFERENCE TO RELATED APPLICATION

This application claims priority of Taiwanese Invention Patent Application No. 107110876, filed on Mar. 29, 2018.

FIELD

The disclosure relates to a nail gun, and more particularly to a nail gun that is prevented from dry-firing.

BACKGROUND

Taiwanese Patent No. 1349600 discloses a conventional nail gun that includes a dry-firing prevention module. The dry-firing prevention module includes a valve member that is resiliently biased for sealing a release chamber, a rod member that is movable along a path of movement and that abuts against the valve member, a stop member that is pivoted to a magazine housing receiving nails therein, and a nail pusher that is movably mounted to the magazine housing and that pushes the nails in the magazine housing. When the number of the nails n the magazine housing is not less than a predetermined amount, the nail pusher is spaced apart from the stop member, and the stop member is resiliently retained on the path of movement of the rod member and abuts against the rod member. At this time, the stop member hinders movement of the rod member and the valve member so that the valve member is maintained at an unblocking position where the valve member unseals the release chamber to permit high-pressure air to be released from the release chamber for firing a nail. When the number of the nails in the magazine housing is less than the predetermined amount, the nail pusher pushes the stop member to remove the stop member from the path of movement of the rod member. At this time, the rod member and the valve member are biased so that an end of the rod member moves past the stop member and that the valve member is moved to a blocking position where the valve member seals the release chamber to prevent the release of the high-pressure air from the release chamber, thereby preventing the firing of the nails.

However, the valve member cannot be moved from the blocking position to the unblocking position to permit the firing of the nails again by the stop member since the end of the rod member has moved past the stop member when the stop member is removed from the path of movement of the rod member. An additional mechanism is needed for moving the valve member from the blocking position to the unblocking position.

SUMMARY

Therefore, an object of the disclosure is to provide a nail gun that can alleviate the drawback of the prior art.

According to the disclosure, the nail gun includes a gun body, a power module, a muzzle module, a magazine module, a firing module and a detection module. The power module is disposed in the gun body. The power module is configured to perform a operation in which the power module outputs a striking force to strike a nail by receiving a first pressure, and is prevented from receiving the first pressure when the power module is subjected to a second pressure. The muzzle module is mounted to the gun body, and defines a nail exit opening. The magazine module is connected to the muzzle module for pushing a plurality of nails to move into the muzzle module one at a time. The firing module is mounted to the gun body, and operable to activate the nail-driving operation for firing the nails via the nail exit opening. The detection module includes a valve rod that is movably mounted to the gun body for controlling the second pressure, and a detection member that is pivoted to the magazine module and that is operable to pivot between an unsealing position and a sealing position. The detection member is moved to the sealing position when the number of the nails in the magazine module is less than a predetermined amount. When the detection member is at the unsealing position, the valve rod is moved away from the detection member to permit release of the second pressure. When the detection member is at the sealing position, the valve rod is moved toward the detection member to prevent the second pressure from being released.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
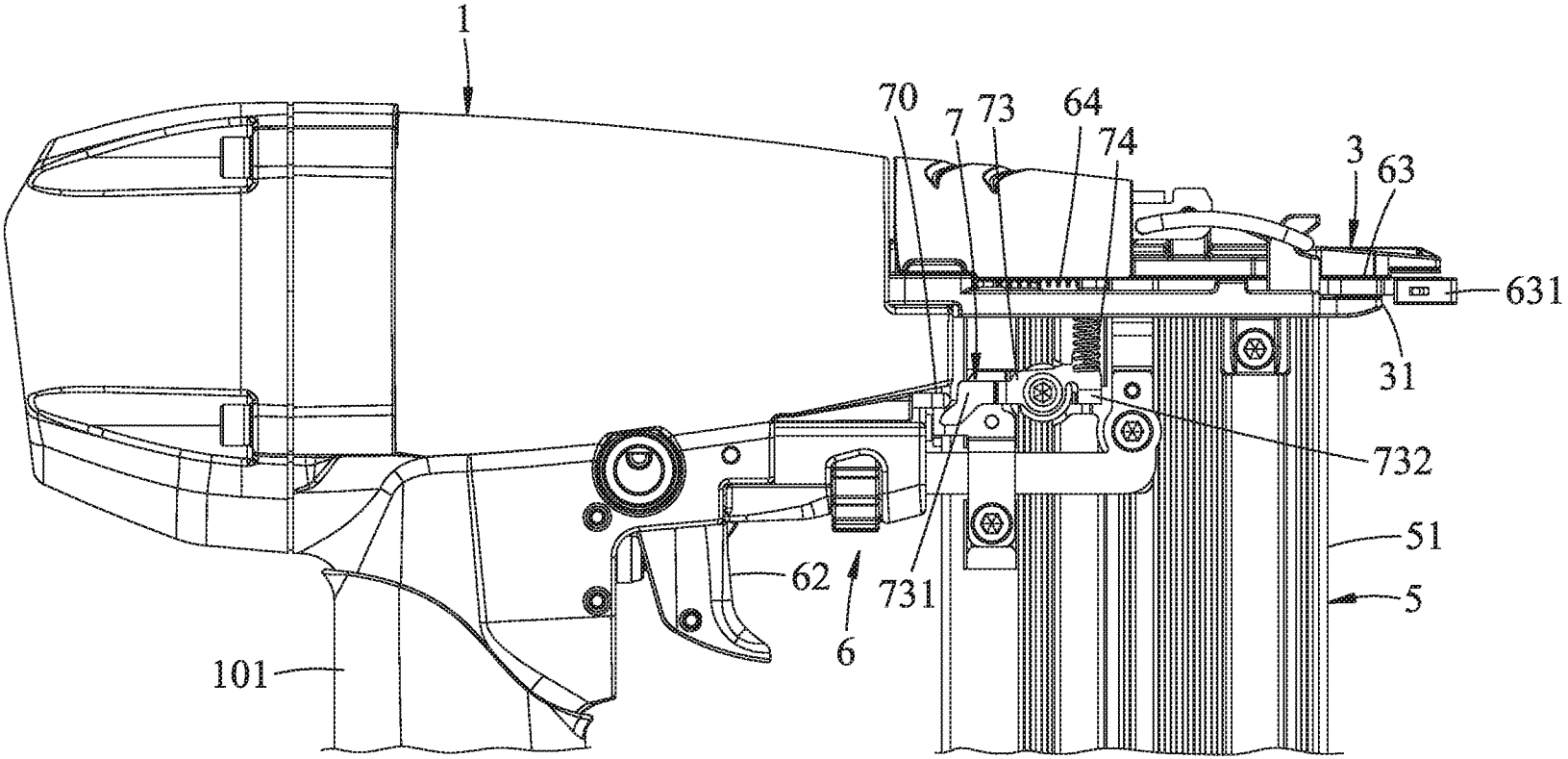
FIG. 1 is a fragmentary side view illustrating a first embodiment of the nail gun according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
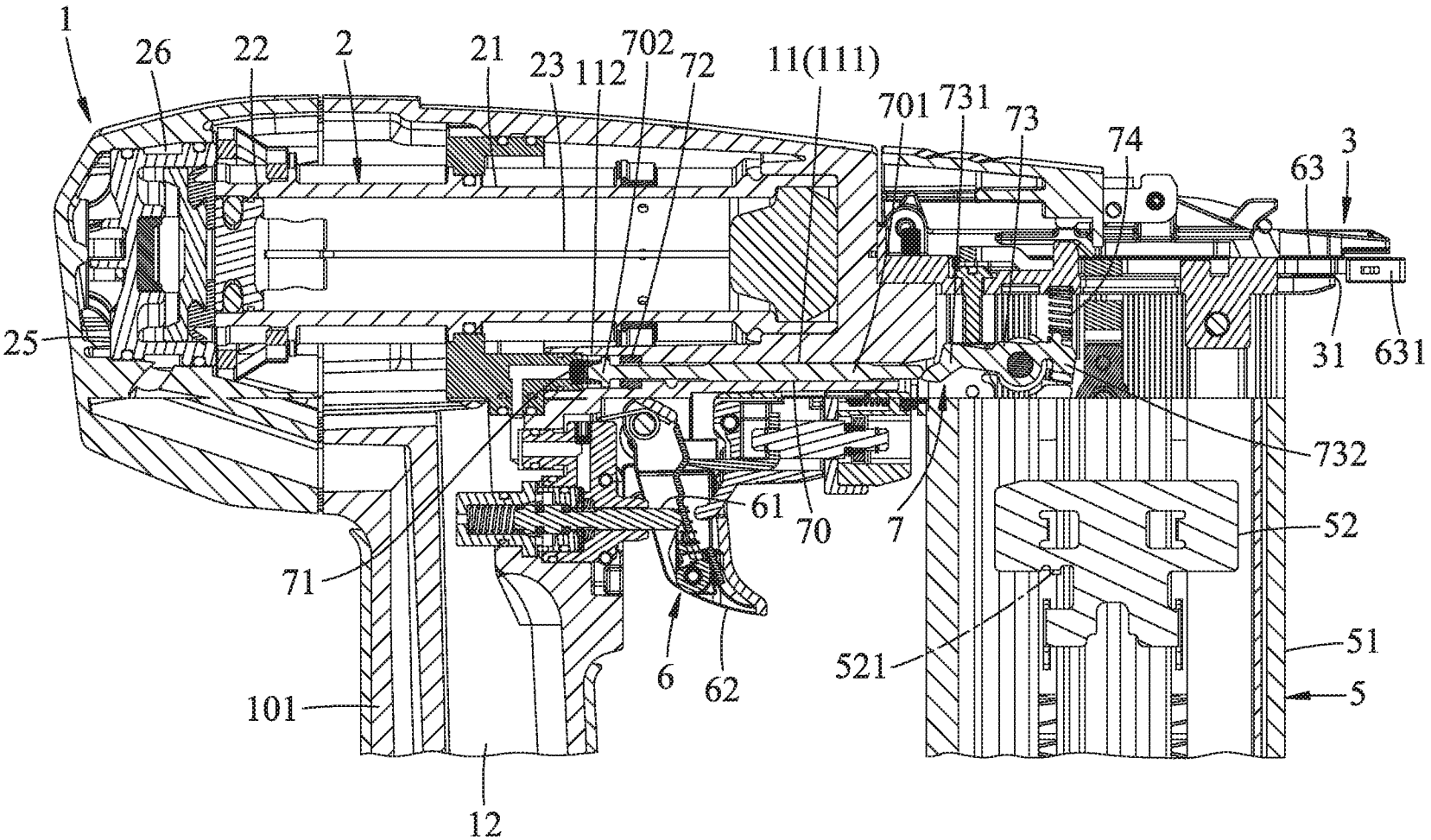
FIG. 2 is a fragmentary sectional view illustrating the first embodiment.

Referring to FIGS. 1 and 2, the embodiment of the nail gun includes a gun body 1, a power module 2, a muzzle module 3, a magazine module 5, a firing module 6 and a detection module 7. The gun body 1 has a handle 101. For convenience sake, in the following paragraphs, a distal portion of the handle 101 is denoted as the lower portion of the nail gun, the muzzle module 3 is denoted as the front portion of the nail gun, and the rest can be deduced by analogy.

With particular reference to FIG. 2, the gun body further has a release flow path 11 that is in communication with the outside of the nail gun and that is disposed adjacent to the magazine module 5, an intake channel 12 that is for introducing high-pressure air into the nail gun to form a first pressure, and a connecting flow path 13 (see FIG. 5) that is in communication with the release flow path 11. The release flow path 11 has a small-diameter section 111, and a large-diameter section 112 that has a diameter larger than that of the small-diameter section 111.

The power module 2 is disposed in the gun body 1, and is configured to perform a nail-driving operation in which the power module 2 outputs a striking force to strike a nail by receiving the first pressure. In one embodiment, the power module 2 uses high-pressure air as the power source, and includes a cylinder 21 that is mounted in the gun body 1, a piston 22 that is movably disposed in the cylinder 21, a drive bit 23 that is co-movably mounted to the piston 22, a head valve 25 that removably blocks the cylinder 21, and a release chamber 26 that is defined between the head valve 25 and the gun body 1 and that is in communication with the release flow path 11. The release chamber 26 receives the high-pressure introduced into the gun body to form a second pressure.

The muzzle module 3 is mounted to a front portion of the gun body 1, and defines a nail exit opening 31.

The magazine module 5 includes a magazine housing 51 that is connected to the muzzle module 3 and that is adapted to receive a plurality of nails (not shown) therein, and a nail feeder 52 that is movably disposed in the magazine housing 51 and that pushes the nails for moving the nails into the muzzle module 3 one at a time. The nail feeder 52 has a projection 521 that projects toward the outside of the magazine housing 51.

The firing module 6 includes a plunger 61 that is movably mounted to the gun body 1 and that is operable for introducing the high-pressure air from the intake channel 12 into the cylinder 21, a trigger assembly 62 that is pivoted to the gun body 1 and that is operable to move the plunger 61, a contact arm 63 that is movably mounted to the gun body 1, and two contact-arm resilient members 64. When the plunger 61 is not operated (see FIG. 2)—the head valve 25 is biased by the second pressure formed by the high-pressure air in the release chamber 26 to block the cylinder 21 so that the cylinder 21 is prevented from receiving the first pressure by the head valve 25. When the plunger 61 is operated to move to an activating position (see FIG. 3), the second pressure in the release chamber 26 is released via the release flow path 11, so that the head valve 25 is biased by the first pressure to unblock the cylinder 21 and that the high-pressure air flows into the cylinder 21 to push the piston 22 and the drive bit 23 for firing the nails via the nail exit opening 31 (i.e., the nail-driving operation is activated). The abovementioned operation is the same as that of a conventional pneumatic nail gun. In one embodiment, the power module 2 may use gas or electric motor as the power source. The operation of a gas nail gun or an electric nail gun is well-known to one having ordinary skill in the art, and is not further described in the following paragraphs.

In some embodiment, the contact arm 63 extends through the muzzle module 3, and has an abutment end 631 that is adjacent to the nail exit opening 31. The contact-arm resilient members 64 are disposed between the contact arm 63 and the muzzle module 3, and resiliently bias the contact arm 63 to move rearwardly. The contact arm 63 is operable to move forwardly so that the abutment end 631 projects out of the nail exit opening 31.

The detection module 7 is disposed in the gun body 1, and includes a valve rod 70, a valve resilient member 71, a sealing ring 72, a detection member 73 and a detection resilient member 74.

The valve rod 70 is movably mounted in the release flow path 11 of the gun body I, and has a rod portion 701 that is disposed in the small-diameter section 111 of the release flow path 11, and a head portion 702 that is disposed in the large-diameter section 112 of the release flow path 11 and that is for removably blocking the small-diameter section 111.

The sealing ring 72 is disposed in the large-diameter section 112 of the release flow path 11, and is located between the small-diameter section 111 and the head portion 702 of the valve rod 70.

The valve resilient member 71 has two opposite ends respectively abutting against the gun body 1 and the head portion 702 of the valve rod. 70, and resiliently biases the head portion 702 of the valve rod. 70 to be in air-tight contact with the sealing ring 72 for blocking the small-diameter section 111 of the release flow path 11.

The detection member 73 is pivoted to the magazine housing 51 and is operable to pivot between an unsealing position (see FIGS. 2 and 3) and a sealing position (see FIGS. 4 and 5), and has a first arm portion 731, and a second arm portion 732 that is opposite to the first arm portion 731 and that is located on the path of movement of the projection 521 of the nail feeder 52. When the detection member 73 is at the unsealing position, the first arm portion 731 pushes the valve rod 70, so that the head portion 702 of the valve rod 70 is spaced apart from the sealing ring 72 and the small-diameter section 111 of the release flow path 11 and that the release flow path 11 is unsealed. When the detection member 73 is at the sealing position, the second arm portion 732 is pushed by the projection 521 of the nail feeder 52 and the first arm portion 731 is moved away from the valve rod 70 so that the valve rod 70 is biased by the valve resilient member 71 to move toward the detection member 73 until the head portion 702 of the valve rod 70 is in air-tight contact with the sealing ring 72 to seal the small-diameter section 111 of the release flow path 11.

The detection resilient member 74 has two opposite ends respectively abutting against the detection member 73 and the muzzle module 3, and resiliently biases the second arm portion 732 such that when the projection 521 of the nail feeder 52 is spaced apart from the second arm portion 732, the first arm portion 731 pushes the valve rod 70 against the biasing action of the valve resilient member 71 to maintain the valve rod 70 to unseal the small-diameter section 121 of the release flow path 11. When the number of the nails in the magazine housing 51 is less than a predetermined amount, the projection 521 of the nail feeder 52 pushes the second arm portion 732 to move against the biasing action of the detection resilient member 74 such that the first arm portion 731 partially removed from the path of movement of the valve rod 70 and that the valve rod 70 is moved to seal the small-diameter section 111 by the valve resilient member 71.

Referring to FIGS. 1 and 2, in a normal state, a distal portion of the trigger assembly 62 is distal from the gun body 1, and the contact arm 63 is maintained at a normal position by the contact-arm resilient members 64 where the abutment end 631 of the contact. arm 63 is proximate to the nail exit opening 31.

Figure 3:
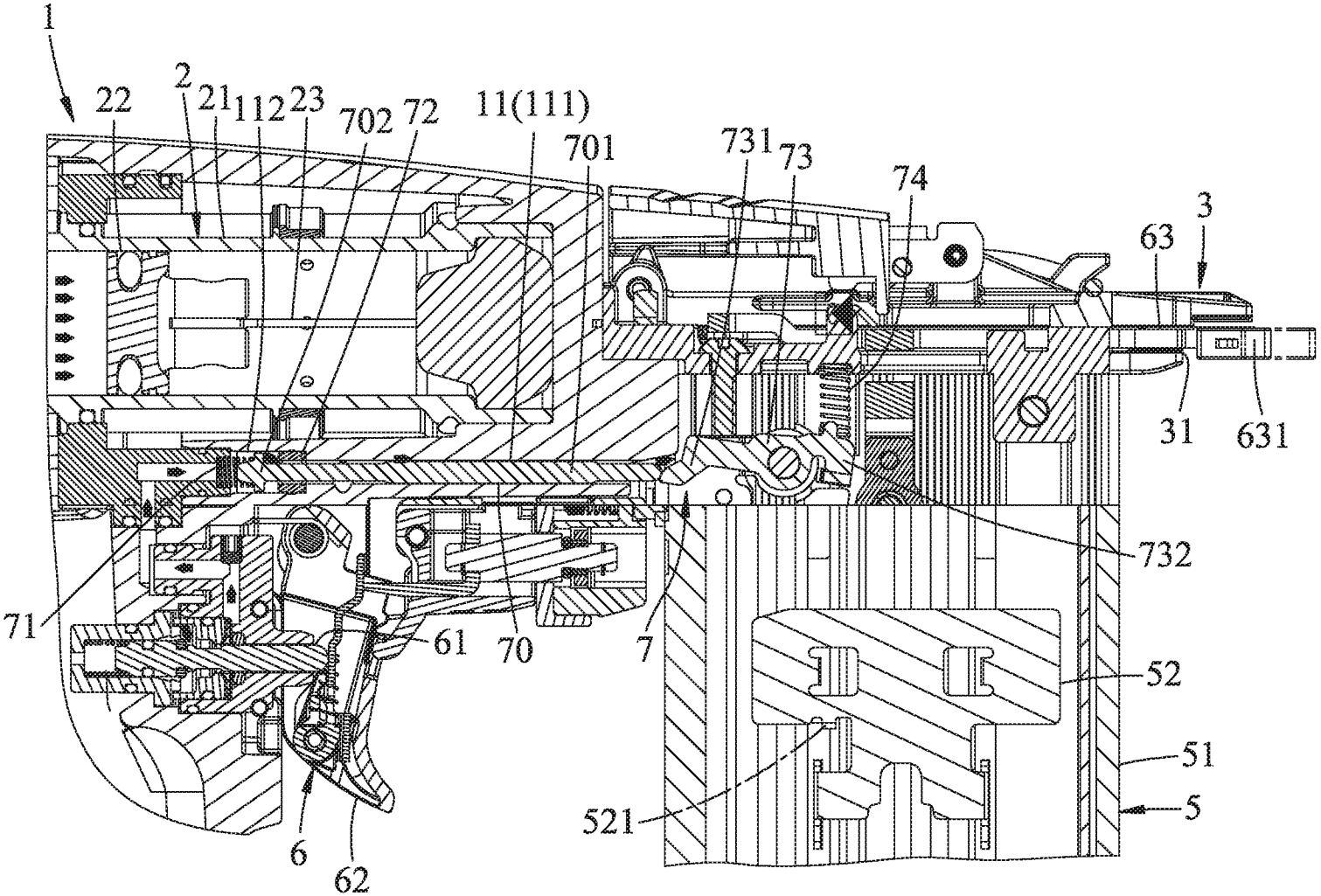
FIG. 3 is another fragmentary sectional view illustrating the first embodiment.

Referring to FIGS. 2 and 3, when the trigger assembly 62 is depressed to pivot rearwardly, the plunger 61 is operated to move to the activating position (see FIG. 3), and the second pressure in the release chamber 26 is released via the release flow path 11, so that the head valve 25 is biased by the first pressure to unblock the cylinder 21 and that the high-pressure air flows into the cylinder 21 to push the piston 22 and the drive bit 23 to fire the nail via the nail exit opening 31.

Figure 4:
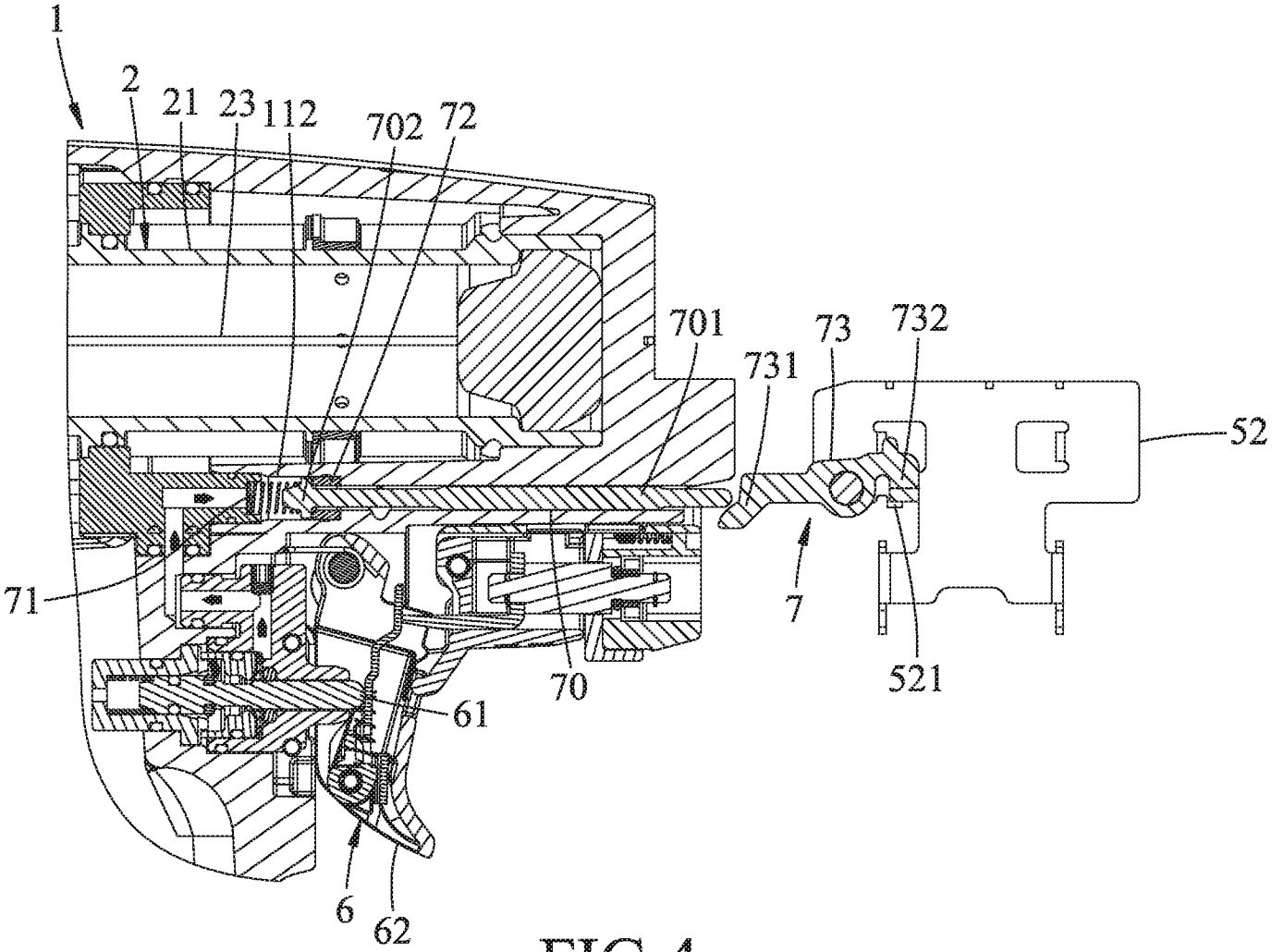
FIG. 4 is a schematic sectional view illustrating a detection member of the first embodiment at a sealing position.
Figure 5:
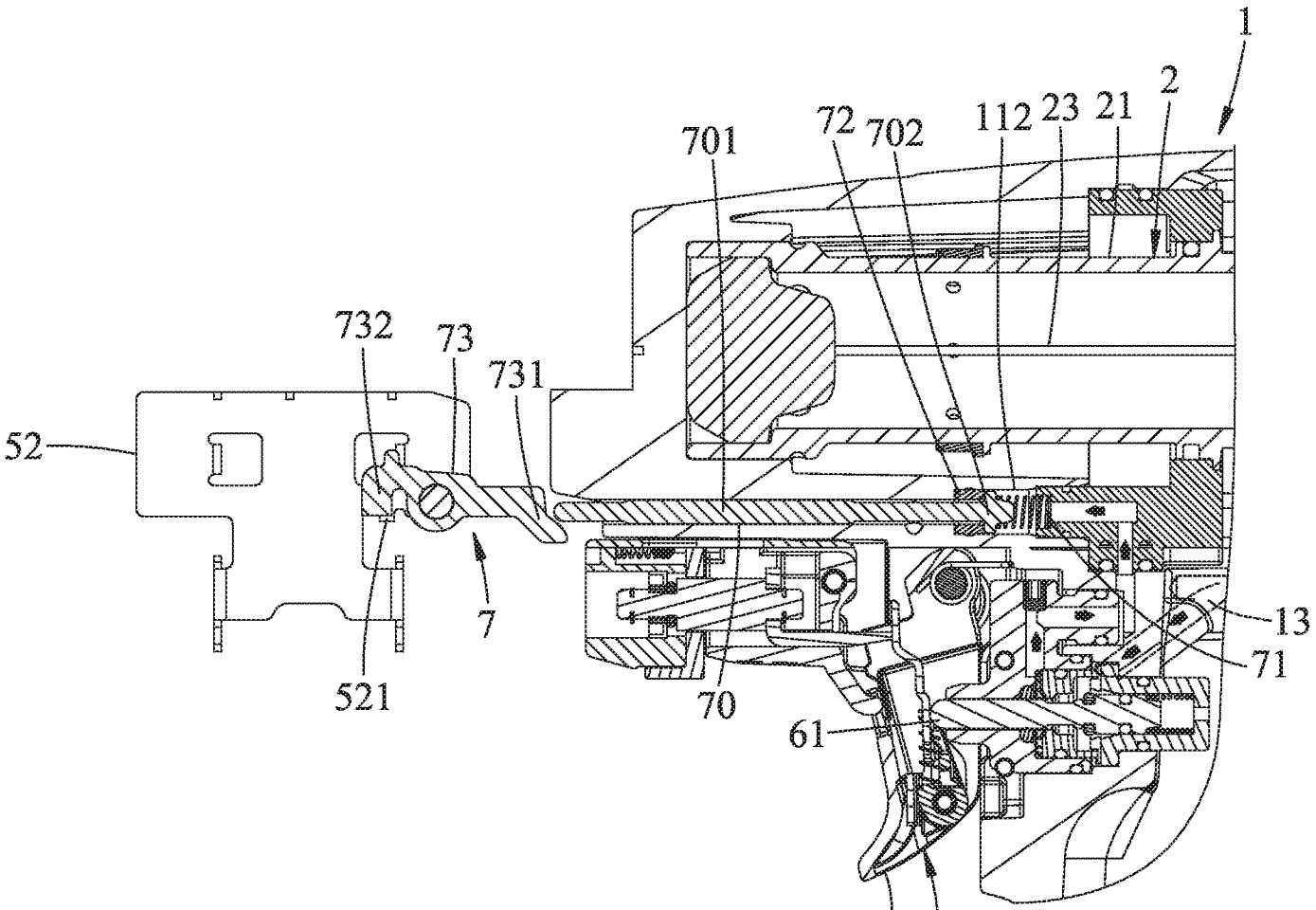
FIG. 5 is another schematic sectional view illustrating the detection member at the sealing position.

Referring to FIGS. 4 and 5, in some embodiment, when the nail feeder 52 pushes the last nail in the magazine housing 51 into the muzzle module 3, the projection 521 of the nail feeder 52 pushes the second arm portion. 732 of the detection member 73 to move against the biasing action of the detection resilient member 74, such that the detection member 73 is moved to the sealing position, in which the first arm portion 731 is partially removed from the path of movement of the valve rod 70, and the valve rod 70 is moved by the valve resilient member 71 to seal up the release flow path 11. As such, even if the plunger 61 is moved to the activating position, the second pressure in the release chamber 26 cannot be released via the release flow path 11, so that the head valve 25 would keep blocking the cylinder 21 and that the high-pressure air (i.e., the first pressure would not be able to flow into the cylinder 21 for striking the nails (i.e., the nail-driving operation cannot be activated). Therefore, dry-firing of the nail gun can be prevented.

It should be noted that, in this embodiment, the magazine module 5 and the detection module 7 are configured such that the release flow path 11 is sealed so as to prevent dry-firing when there is no nail in the magazine housing 51. In a modification, the magazine module 5 and the detection module 7 may be configured such that the release flow path 11 is sealed when the number of the nails 7 in the magazine housing 41 is less than a predetermined amount.

To sum up, since the first arm portion 731 of the detection member 73 is not completely removed from the path of movement of the valve rod 70 when the detection member 73 is at the sealing position, the valve rod 70 can be moved to unseal the release flow path 11 by the movement of the detection member 73 from the sealing position to the unsealing position without additional restoring structure.

In the description above, for the purposes of explanation, numerous specific details have been set forth in order to provide a thorough understanding of the embodiment. It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A nail gun comprising:

a gun body;

a power module disposed in said gun body, said power module being configured to perform a nail-driving operation in which said power module outputs a striking force to strike a nail by receiving a first pressure, and prevented from receiving the first pressure when said power module is subjected to a second pressure;

a muzzle module mounted to said gun body, and defining a nail exit opening;

a magazine module connected to said muzzle module for pushing a plurality of nails to move into said muzzle module one at a time;

a firing module mounted to said gun body, and operable to activate the nail-driving operation for firing the nails via said nail exit opening; and a detection module including a valve rod that is movably mounted to said gun body for controlling the second pressure, and a detection member that is pivoted to said magazine module and that is operable to pivot between an unsealing position and a sealing position, said detection member being moved to the sealing position when the number of the nails in said magazine module is less than a predetermined amount;

wherein, when said detection member is at the unsealing position, said valve rod is pushed by said detection member to move away from said detection member to permit release of the second pressure; and wherein when said detection member is at the sealing position, said valve rod is moved toward said detection member to prevent the second pressure from being released.

2. The nail gun as claimed in claim 1, wherein said gun body has a release flow path, said power module including a cylinder that is for receiving the first pressure, a head valve that removably blocks said cylinder, and a release chamber that is defined between said head valve and said gun body and that is in communication with said release flow path, said valve rod being movably mounted in said release flow path.

3. The nail gun as claimed in claim 2, wherein said gun body further has an intake channel that is for introducing high-pressure air to form a first pressure, said firing module including a plunger that is movably mounted to said gun body and that is operable for introducing the first pressure into said cylinder, and a trigger assembly that is pivoted to said gun body and that is operable to drive said plunger.

4. The nail gun as claimed in claim 2, wherein said release flow path has a small-diameter section, and a large-diameter section that has a diameter larger than that of said small-diameter section, said valve rod having a rod portion that is disposed in said small-diameter section of said release flow path, and a head portion that is disposed in said large-diameter section of said release flow path and that is for removably blocking said small-diameter section.

5. The nail gun as claimed in claim 4, wherein said detection module further includes a sealing ring that is disposed in said large-diameter section of said release flow path and that is located between said small-diameter section and said head portion of said valve rod, said head portion of said valve rod being in air-tight contact with said sealing ring when said detection member is at the sealing position.

6. The nail gun as claimed in claim 1, wherein said magazine module includes a magazine housing that is adapted to receive the nails therein, and a nail feeder that is movably disposed in said magazine housing and that pushes the nails for moving the nails into said muzzle module one at a time, said detection member being pivoted to said magazine housing and having a first arm portion that is for pushing said valve rod, and a second arm portion that is opposite to said first arm portion and that is located on the path of movement of the said nail feeder, said nail feeder driving said second arm portion of said detection member to move said detection member to the sealing position when the number of the nails in said magazine housing is less than a predetermined amount.

7. The nail gun as claimed in claim 6, wherein said nail feeder has a projection that projects toward the outside of said magazine housing, said projection of said nail feeder driving said second arm portion of said detection member to move said detection member to the sealing position when the number of the nails in said magazine housing is less than a predetermined amount.

8. The nail gun as claimed in claim 6, wherein said detection module further includes a detection resilient member, said detection resilient member having two opposite ends that respectively abut against said detection member and said muzzle module, and resiliently biasing the second arm portion for maintaining said detection member at the unsealing position.

9. The nail gun as claimed in claim 1, wherein said detection module further includes a valve resilient member that has two opposite ends respectively abutting against said gun body and said valve rod, and resiliently biases said valve rod to prevent the second pressure from being released.

10. The nail gun as claimed in claim 1, wherein said firing module includes a contact arm that is movably mounted to said gun body, and a trigger assembly that is pivoted to said gun body, said contact arm having an abutment end that is adjacent to said nail exit opening, said trigger assembly operable to activate the nail-driving operation.

11. The nail gun as claimed in claim 10, wherein said contact arm is operable to move forwardly so that said abutment end projects out of said nail exit opening.

* * * * *